US006308716B1

(12) United States Patent
Han

(10) Patent No.: US 6,308,716 B1
(45) Date of Patent: Oct. 30, 2001

(54) CORE FOR AN ADHESIVE DEVICE FOR ATTACHING A FALSE EYELASH

(76) Inventor: Yongho Han, 8 Clearmeadow Ct., Woodbury, NY (US) 11797

( * ) Notice: Subject to any disclaimer, the term of this patent is extended or adjusted under 35 U.S.C. 154(b) by 0 days.

(21) Appl. No.: 09/633,804

(22) Filed: Aug. 7, 2000

(51) Int. Cl.[7] ..... A41G 5/02
(52) U.S. Cl. ..... 132/53; 206/823; 428/392
(58) Field of Search ..... 132/53, 54, 55, 132/56, 201, 216; 206/581, 813, 823; 428/375, 378, 392, 394

(56) References Cited

U.S. PATENT DOCUMENTS

| | | | | |
|---|---|---|---|---|
| 1,897,747 | * | 2/1933 | Birk | 132/53 |
| 2,835,259 | * | 5/1958 | Goodman | 132/53 |
| 3,266,500 | | 8/1966 | Weld | 132/53 |
| 3,362,417 | * | 1/1968 | Glaser | 132/201 |
| 3,447,542 | | 6/1969 | McCullough | 132/53 |
| 3,622,438 | * | 11/1971 | Esler et al. | 161/175 |
| 3,885,671 | | 5/1975 | Spiegel et al. | 206/460 |
| 4,018,336 | * | 4/1977 | Aylott | 206/460 |
| 4,858,631 | * | 8/1989 | Chuang | 132/218 |
| 6,029,674 | | 2/2000 | Han | 132/216 |

* cited by examiner

*Primary Examiner*—Gene Mancene
*Assistant Examiner*—David C. Comstock
(74) *Attorney, Agent, or Firm*—Richard L. Miller, P.E

(57) ABSTRACT

An improved core for an adhesive device for attaching a false eyelash to an eyelid. The adhesive device is of a type that has a core, an adhesive coating that surrounds the core so as to form an attaching element, a primary substrate that is a card and has a face with an upper area that has a display throughbore therethrough for a hanging display and a lower area, a secondary substrate that is disposed on the upper area of the primary substrate, below the display throughbore therethrough, and a plurality of release sheet covers that are individual and separate from each other. The improvement includes the core being a plurality of synthetic fibers laid side by side and not twisted, braided, interwoven, intertwined, entwined, or interlaced with each other. Each synthetic fiber is thin, smooth, and does not absorb the adhesive coating so as to remain soft and pliable.

14 Claims, 2 Drawing Sheets

FIG. 5 (PRIOR ART)
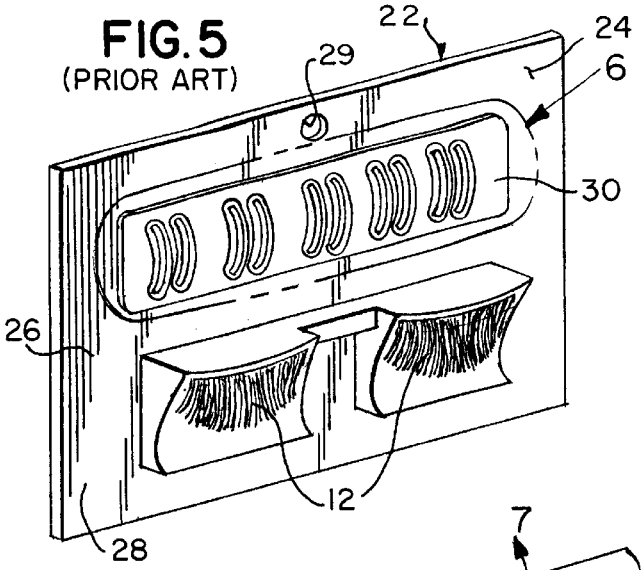
FIG. 4 (PRIOR ART)
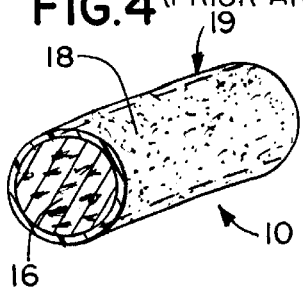
FIG. 6 (PRIOR ART)
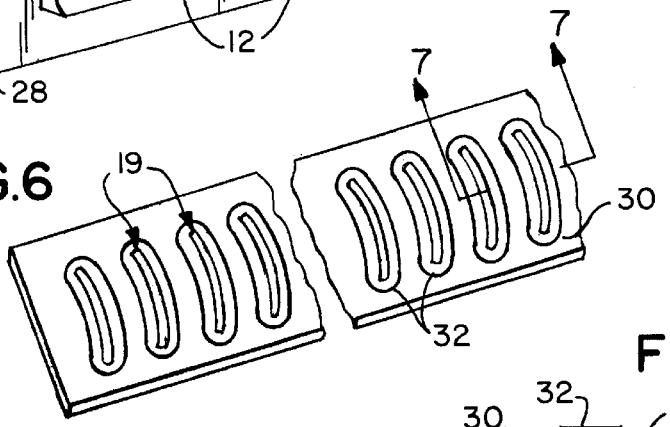
FIG. 7 (PRIOR ART)
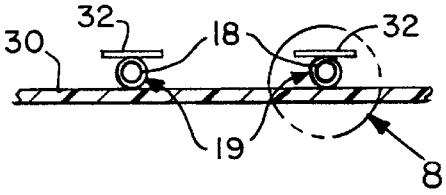
FIG. 8 (PRIOR ART)
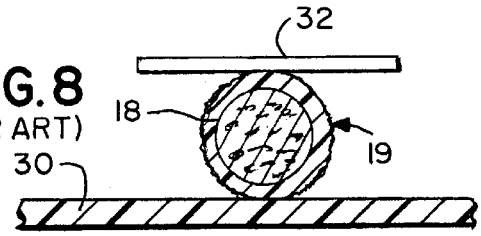
FIG. 1 (PRIOR ART)
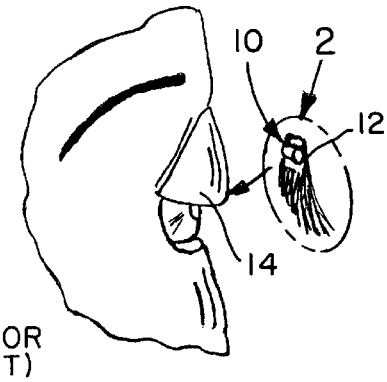
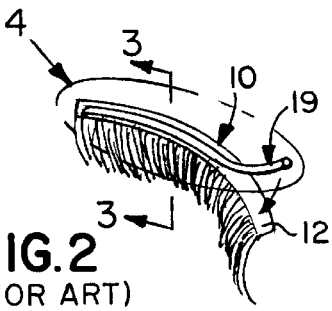
FIG. 2 (PRIOR ART)
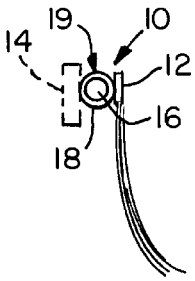
FIG. 3 (PRIOR ART)

CORE FOR AN ADHESIVE DEVICE FOR ATTACHING A FALSE EYELASH

BACKGROUND OF THE INVENTION

1. Field of the Invention

The present invention relates to a core for an adhesive device for attaching a false eyelash to an eyelid. More particularly, the present invention relates to an improved core for an adhesive device for attaching a false eyelash to an eyelid.

2. Description of the Prior Art

Numerous innovations for false eyelashes have been provided in the prior art. Even though these innovations may be suitable :for the specific individual purposes to which they address, however, they differ from the present invention. Furthermore, even though these innovations may be suitable for the specific individual purposes to which they address, however, they would not be suitable for the purposes of the present invention as heretofore described.

A FIRST EXAMPLE, U.S. Pat. No. 2,835,259 to Goodman teaches an integral one-piece artificial eyelash unit, formed by slitting and slotting a thin sheet of material with an adhesive border at one side and outwardly projecting eyelash colored thin narrow flat rectangular cross section strips at the other side, said strips and said border being integrally joined and being formed from the same thin sheet of material without separation of the strips and the border.

A SECOND EXAMPLE, U.S. Pat. No. 3,266,500 to Weld teaches a device for application to the upper eyelid of a person: a curved elongate base sheet of flexible and conformable material having one end extending downwardly and the other end extending in a different direction from said one end, said base sheet providing an outline to extend along and substantially cover the upper eyelid; a pressure sensitive adhesive coating on the back surface of said sheet adapted to removably adhere said sheet to the upper eyelid; said base sheet having a layer of a desired visible color on its front surface, said color being noticeably different from the Color of the eyelid.

A THIRD EXAMPLE, U.S. Pat. No. 3,362,417 to Glaser teaches an article for attachment to the human eyelid for adornment of the human eye comprising a portion of a feather, exclusive of the shaft thereof, said portion having a length sufficient to enable it to be attached to a human eyelid and to substantially overlie the eyelashes of the eyelid, said portion consisting essentially of a plurality of naturally arranged and integrated feather barbs, said barbs being anchored at a point along their length to a narrow, thin, common, flexible support base formed from a rubbery material and having a length substantially greater than that of the natural eyelashes of the eyelid and a configuration to enable them to substantially mask the natural eyelashes of the eyelid, said common base being capable of conforming to the contours of the eye in ally position of the eyelid and serving to carry an adhesive material for attaching the article to the eyelid and having a length sufficient to enable the article to be attached to a human eyelid.

A FOURTH EXAMPLE, U.S. Pat. No. 3,447,542 to McCullough teaches a combination eyeliner and false eyelash comprising an elongated flexible leather eyeliner having an inner and outer surface of a thickness between 5 to 40 thousandths of an inch; and a false eyelash permanently and flexibly bonded to the inner surface of said eyeliner with the lashes substantially perpendicular to the eyeliner length.

A FIFTH EXAMPLE, U.S. Pat. No. 3,622,438 to Esler et al. teaches a thermoplastic adhesive coated yarn or filament employed in the manufacture of boxing for upholstery and the like. The yarn or filament contains a uniform coating of a thermoplastic material which has sufficiently high viscosity to prevent the thermoplastic material from bleeding through the fabric to which it adheres at ordinary temperatures, and with viscosity low enough to permit coating of the filament or yarn uniformly at coating temperatures and such that a sufficient degree of melting will take place at the application temperature for the sticking of the thermoplastic adhesive to the boxing fabric. In a preferred embodiment of the invention, a rayon filament is coated with a layer of a polymer or ethylene, preferably an ethylene-butene-1 copolymer, the copolymer has a molecular weight of less than 10,000, has dissolved therein and organic acid ester which produces a composition having a viscosity at 300 degrees of 100,000 to 200,000 c.p.s., and a viscosity at 350 degrees of less than 8,500 c.p.s. The preferred organic acid ester is ethyl palmitate.

A SIXTH EXAMPLE, U.S. Pat. No. 3,885,671 to Spiegel et al. teaches a carded package including an article disposed within a heat shrinkable tubing. The tubing is connected to the card via an adhesive thereon. The securement of the adhesive to the card is enhanced by providing plural perforations in the surface of the card and applying the adhesive to the card at the perforated area.

A SEVENTH EXAMPLE, U.S. Pat. No. 6,029,674 to Han teaches a device for attaching a false eyelash with an original adhesive thereon to an eyelid when the original adhesive thereon has lost its adhesivity. The device includes a core and an adhesive coating that surrounds the core so as to form an attaching element. The adhesive coating attaches the core along the false eyelash and also allows the false eyelash to then be attached to the eyelid. The device further includes, a primary substrate, a secondary substrate disposed on the primary substrate and has a plurality of the attaching elements spaced longitudinally therealong and held releasibly thereon by the adhesive coating of each attaching element, a plurality of release sheet covers, each of which covers and protects an associated attaching element, prior to use, and is held releasibly thereon by the adhesive coating of the associated attaching element, and at least one pair of false eyelashes disposed on the primary substrate.

A more detailed description of U.S. Pat. No. 6,029,674 to Han, of which the instant invention is an improvement of, can best be seen in FIGS. 1–8, and as such, will be discussed with reference thereto.

Referring now to FIG. 1, the device for attaching a false eyelash when the original adhesive thereon has lost its adhesivity is shown generally at 10 for attaching a false eyelash 12 with an original adhesivity thereon to an eyelid 14 when the original adhesive thereon has lost its adhesivity.

The configuration of the device for attaching a false eyelash when the original adhesive thereon has lost its adhesivity 10 can best be seen in FIGS. 2–8, and as such, will be discussed with reference thereto.

The device for attaching a false eyelash when the original adhesive thereon has lost its adhesivity 10 comprises a core 16 and an adhesive coating 18 surrounding the core 16 so as to form an attaching element 19.

The adhesive coating 18 is for attaching the core 16 along the false eyelash 12 and for also allowing the false eyelash 12 to then be attached to the eyelid 14.

The core 16 is elongated and slender, and is preferably a thread or a mono-filament.

The adhesive coating 18 is pressure sensitive.

The device for attaching a false eyelash when the original adhesive thereon has lost its adhesivity 10 further comprises a primary substrate 22 that is a card and has a face 24 with an upper area 26 and a lower area 28.

The upper area 26 of the primary substrate 22 has a display throughbore 29 therethrough for a hanging display.

The device for attaching a false eyelash when the original adhesive thereon has lost its adhesivity 10 further comprises a secondary substrate 30 that is a card and disposed on the upper area 26 of the primary substrate 22, below the display throughbore 29 therethrough so as not to interfere with hanging.

The secondary substrate 30 has a plurality of the attaching elements 19 spaced longitudinally therealong and held releasibly thereon by the adhesive coating 18 of each associated attaching element 19.

The device for attaching a false eyelash when the original let, adhesive thereon has lost its adhesivity 10 further comprises a plurality of release sheet covers 32 that are individual and separate from each other.

Each release sheet cover 32 covers and protects an associated attaching element 19, prior to use, and is held releasibly thereon by the adhesive coating 18 of the associated attaching element 19.

The device for attaching a false eyelash when the original adhesive thereon has lost its adhesivity 10 further comprises at least one pair of the false eyelash 12 that are disposed on the lower area 28 of the primary substrate 22.

It is apparent that numerous innovations for false eyelashes have been provided in the prior art that are adapted to be used. Furthermore, even though these innovations may be suitable for the specific individual purposes to which they address, however, they would not be suitable for the purposes of the present invention as heretofore described.

SUMMARY OF THE INVENTION

ACCORDINGLY, AN OBJECT of the present invention is to provide an improved core for an adhesive device for attaching a false eyelash to an eyelid that avoids the disadvantages of the prior art.

ANOTHER OBJECT of the present invention is to provide an improved core for an adhesive device for attaching a false eyelash a to an eyelid that is simple and inexpensive to manufacture.

STILL ANOTHER OBJECT of the present invention is to provide an improved core for an adhesive device for attaching a false eyelash to an eyelid that is simple to use.

BRIEFLY STATED, YET ANOTHER OBJECT of the present invention is to provide an improved core for an adhesive device for attaching a false eyelash to an eyelid. The adhesive device is of a type that has a core, an adhesive coating that surrounds the core so as to form an attaching element, a primary substrate that is a card and has a face with an upper area that has a display throughbore therethrough for a hanging display and a lower area, a secondary substrate that is disposed on the upper area of the primary substrate, below the display throughbore therethrough so as to not to interfere with hanging, and a plurality of release sheet covers that are individual and separate from each other. The improvement includes the core being a plurality of synthetic fibers laid side by side and not twisted, braided, interwoven, intertwined, entwined, or interlaced with each other so as to assure that the plurality of synthetic fibers lay right, and are comfortable, on the eyelid. Each synthetic fiber is thin, smooth, and does not absorb the adhesive coating so as to remain soft and pliable, as compared to a thread or a mono-filament which is thick, not smooth, and does absorb the adhesive coating so as not to remain soft and pliable.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures of the drawing are briefly described as follows:

FIG. 1 is a diagrammatic perspective view of the present invention in use;

FIG. 2 is an enlarged diagrammatic perspective view of the area generally enclosed by the dotted curve identified by arrow 2 in FIG. 1;

FIG. 3 is an enlarged diagrammatic cross sectional view taken on line 3—3 in FIG. 2;

FIG. 4 is an enlarged diagrammatic perspective view of the area generally enclosed by the dotted curve identified by arrow 3 in FIG. 2 of the present invention;

FIG. 5 is a diagrammatic perspective view of a false eyelash kit utilizing the present invention;

FIG. 6 is an enlarged diagrammatic perspective view of the area generally enclosed by the dotted curve identified by arrow 6 in FIG. 5;

FIG. 7 is a diagrammatic cross sectional view taken on line 7—7 in FIG. 6;

FIG. 8 is an enlarged diagrammatic cross sectional view of the are generally enclosed by the dotted curve identified by arrow 8 in FIG. 7;

LIST OF REFERENCE NUMERALS UTILIZED IN THE DRAWING

Prior Art

Figure 11:
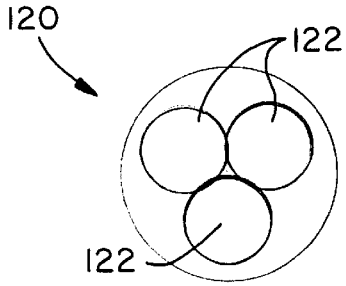
FIG. 11 is a diagrammatic end view of a first embodiment of the present invention.

10 device for attaching a false eyelash when the original adhesive thereon has lost its adhesivity
12 false eyelash
14 eyelid
16 core
18 adhesive coating for attaching core 16 along false eyelash 12 and allowing false eyelash 12 to be attached to eyelid 14
19 attaching element
22 primary substrate
24 face of primary substrate 22

26 upper area of face 24 of primary substrate 22
28 lower area of face 24 of primary substrate 22
29 display throughbore through upper area 26 of face 24 of primary substrate 22 for hanging display
30 secondary substrate
32 plurality of release sheet covers Present Invention

40 improved core for an adhesive device for attaching a false eyelash to an eyelid of present invention
42 plurality of synthetic fibers First Embodiment

120 improved core
122 three synthetic fibers

Second Embodiment

220 improved core
222 three synthetic fibers
224 plane

Third Embodiment

320 improved core
322 five synthetic fibers
324 central synthetic fiber of five synthetic fibers 322
326 four other synthetic fibers of five synthetic fibers 322

Fourth Embodiment

420 improved core
422 five synthetic fibers
424 pair of parallel planes Fifth Embodiment

520 improved core
522 seven synthetic fibers
524 central synthetic fiber of seven synthetic fibers 522
526 six other synthetic fibers of seven synthetic fibers 522

DETAILED DESCRIPTION OF THE PREFERRED EMBODIMENT

Figure 9:
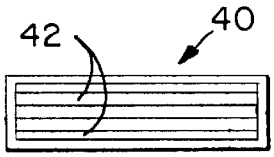
FIG. 9 is a diagrammatic side elevational view of the improvement made by the present invention to the core shown in FIG. 4.
Figure 10:
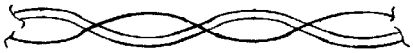
FIG. 10 is a diagrammatic side elevational view of a core not made by the present invention.

Referring now to the figures, in which like numerals indicate like parts, and particularly to FIGS. 9 and 10, the improved core for an adhesive device for attaching a false eyelash to an eyelid of the present invention is shown generally at 40.

The improvement comprises a plurality of synthetic fibers 42 laid side by side (see FIG. 9) and not twisted, braided, interwoven, intertwined, entwined, or interlaced with each other (see FIG. 10) so as to assure that the plurality of synthetic fibers 42 lay right, and are comfortable, on the eyelid.

Each synthetic fiber 42 is thin, smooth, and does not absorb the adhesive coating 18 (prior art) so as to remain soft and pliable, as compared to the thread 16 (prior art) or the mono-filament 16 (prior art) which is thick, not smooth, and does absorb the adhesive coating 18 (prior art) so as not to remain soft and pliable.

Even though "not twisted, braided, interwoven, intertwined, entwined, or interlaced with each other" and "does not absorb the adhesive coating 18" may be considered negative limitations by some, it is the only way, and by far the clearest way, to state the limitations, and therefore must be considered in determining patentability. Support for this assertion can be found in the notice entitled "*Practice Re: Technical Rejections,*" dated Apr. 30, 1965 (814 O.G. 715), which states that:

> "The inclusion of a negative limitation shall not, in itself, be considered a sufficient basis for objection to or rejection of a claim." [Emphasis added]

And, in In re Duva, 156 USPQ 90, 94 (CCPA 1967), where the Court stated:

> ". . . it [is] held proper to claim a negative limitation even if a positive expression could have been employed and even at the 'point of novelty' . . . " [Emphasis added]

The fact that the plurality of synthetic fibers 42 are not twisted, braided, interwoven, intertwined, entwined, or interlaced with each other and do not absorb the adhesive coating 18 are of critical importance and obviously points of novelty, since twisting braiding, interweaving, intertwining, entwining, or interlacing the plurality of synthetic fibers 42 with each other would prevent the plurality of synthetic fibers 42 from laying right on the eyelid, and more importantly, would be uncomfortable to the eyelid, <nd absorbing the adhesive coating 18 would prevent the core from being soft and pliable.

And, even though "twisted, braided, interwoven, intertwined, entwined, or interlaced with each other" and "thread or mono-filament" are alternative expressions, their use is permitted, since they contain equivalents, respectively, as per MPEP 706.03-d (Jul. 23, 1968), where it is ruled:

> "Alternative expressions such as 'brake or locking device' may make a claim indefinite if the limitation covers two different elements. If two equivalent arts are referred to such as 'rods and bars,' [however,] the alternative expression may be considered proper." [Emphasis added]

And, as was decided in In re Wolfrum and Gold, 179 USPQ 620 (CCPA 1973), where the Court held:

> "Section 112 would not support such a rejection [as an alternative] since it was clear what the applicant intended to claim, and that is all Section 112 requires." [Emphasis added]

And, further in In re Hans, 179 USPQ 623 (CCPA 1973); and In re Pavlecka, 138 USPQ 118 (CCPA 1963).

A typical synthetic fiber 42 is sold under the trademark "MODLON-21(R), Model DKP-550 by the JP CORPORATION of C.P.O. Box 6482; Seoul, Korea; Tel. 82-2-938-7782; Fax. 82-2-938-4540 or under the name "TOYOKALON" by TOYO CHEMICAL CO., LTD. of Tokyo Japan.

The improvement further comprises each of the plurality of synthetic fibers 42 has a thickness in a range of approximately 45 denier to approximately 70 denier.

As shown throughout the figures, the improvement further comprises the plurality of synthetic fibers 42 being an odd number of synthetic fibers.

A first embodiment of the improved core 120 can best be seen in FIG. 11, and as such, will be discussed with reference thereto. improvement further comprises the plurality of synthetic fibers 42 being three synthetic fibers 122 that do not lie in a plane, wherein each of the three synthetic fibers 122 touch the two other synthetic fibers.

Figure 12:
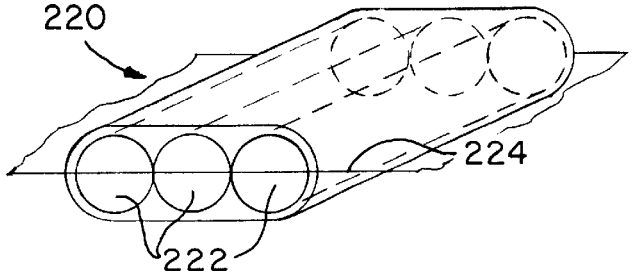
FIG. 12 is a diagrammatic end view of a second embodiment of the present invention.

A second embodiment of the improved core 220 can best be seen in FIG. 12, and as such, will be discussed with reference thereto.

The improvement further comprises the plurality of synthetic fibers 42 being three synthetic fibers 222 that lie in a plane 224.

Figure 13:
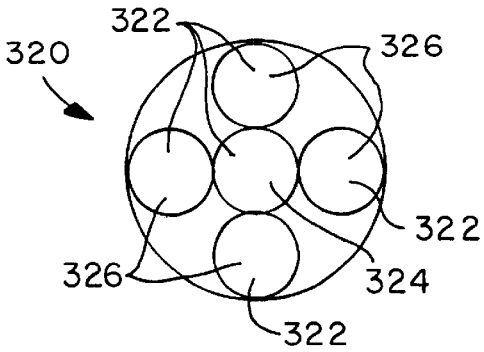
FIG. 13 is a diagrammatic end view of a third embodiment of the present invention.

A third embodiment of the improved core 320 can best be seen in FIG. 13, and as such, will be discussed with reference thereto.

The improvement further comprises the plurality of synthetic fibers 42 being five synthetic fibers 322 that do not lie in a plane, and comprise a central synthetic fiber 324 surrounded by the four other synthetic fibers 326.

Figure 14:
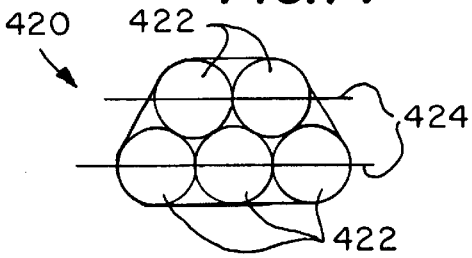
FIG. 14 is a diagrammatic end view of a fourth embodiment of the present invention.

A fourth embodiment of the improved core 420 can best be seen in FIG. 14, and as such, will be discussed with reference thereto.

The improvement further comprises the plurality of synthetic fibers 42 being five synthetic fibers 422 that lie in a pair of parallel planes 424.

Figure 15:
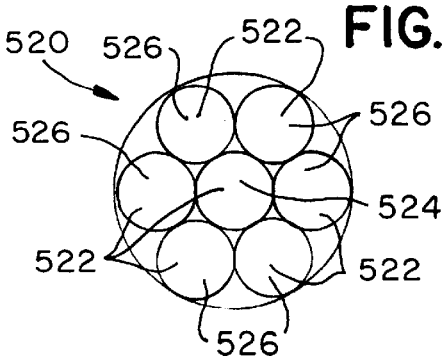
FIG. 15 is a diagrammatic end view of a fifth embodiment of the present invention.

A fifth embodiment of the improved core 520 can best be seen in FIG. 15, and as such, will be discussed with reference thereto.

The improvement further comprises the plurality of synthetic fibers 42 being seven synthetic fibers 522 that do not lie in a plane, and comprise a central synthetic fiber 524 surrounded by the six other synthetic fibers 526.

It will be understood that each of the elements described above, or two or more together, may also find a useful application in other types of constructions differing from the types described above.

While the invention has been illustrated and described as embodied in an improved core for an adhesive device for attaching a false eyelash to an eyelid, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. An improved plurality of adhesive devices releasably affixed to a display card of a type having a core, an adhesive coating surrounding the core so as to form an attaching element, a primary substrate being the display card and having a face with an upper area having a display throughbore therethrough for a hanging display and a lower area, a secondary substrate disposed on the upper area of the primary substrate, below the display throughbore therethrough so as to not to interfere with hanging, and a plurality of release sheet covers being individual and separate from each other, wherein the adhesive coating is for attaching the core along a false eyelash and for also allowing the false eyelash to then be attached to an eyelid, wherein the secondary substrate has a plurality of the attaching elements spaced longitudinally therealong and held releasably thereon by the adhesive coating of each attaching element, wherein the core is elongated and slender, wherein the adhesive coating is pressure sensitive, and wherein each release sheet cover covers and protects an associated attaching element, prior to use, and is held releasably thereon by the adhesive coating of the associated attaching element, said improvement comprising the core being a plurality of synthetic fibers laid side by side and not twisted, braided, interwoven, intertwined, entwined, or interlaced with each other so as to assure that said plurality of synthetic fibers lay right, and are comfortable, on the eyelid, wherein each synthetic fiber is thin, smooth, and does not absorb the adhesive coating so as to remain soft and pliable, as compared to a thread or a mono-filament which is thick, not smooth, and does absorb the adhesive coating so as not to remain soft and pliable.

2. The improvement as defined in claim 1, wherein each of said plurality of synthetic fibers has a thickness in a range of approximately 45 denier to approximately 70 denier.

3. The improvement as defined in claim 1, wherein said improvement further comprises said plurality of synthetic fibers being an odd number of synthetic fibers.

4. The improvement as defined in claim 1, wherein said improvement further comprises said plurality of synthetic fibers being three synthetic fibers.

5. The improvement as defined in claim 4, wherein said improvement further comprises said three synthetic fibers not lying in a plane.

6. The improvement as defined in claim 4, wherein said improvement further comprises each of said three synthetic fibers touching the two other synthetic fibers.

7. The improvement as defined in claim 4, wherein said improvement further comprises said three synthetic fibers lying in a plane.

8. The improvement as defined in claim 1, wherein said improvement further comprises said plurality of synthetic fibers being five synthetic fibers.

9. The improvement as defined in claim 8, wherein said improvement further comprises said five synthetic fibers not lying in a plane.

10. The improvement as defined in claim 8, wherein said improvement further comprises said five synthetic fibers having a central synthetic fiber surrounded by the four other synthetic fibers.

11. The improvement as defined in claim 8, wherein said improvement further comprises said five synthetic fibers lying in a pair of parallel planes.

12. The improvement as defined in claim 1, wherein said improvement further comprises said plurality of synthetic fibers being seven synthetic fibers.

13. The improvement as defined in claim 12, wherein said improvement further comprises said seven synthetic fibers not lying in a plane.

14. The improvement as defined in claim 12, wherein said improvement further comprises said seven synthetic fibers having a central synthetic fiber surrounded by the six other synthetic fibers.

* * * * *